US006217247B1

(12) United States Patent
Ng

(10) Patent No.: US 6,217,247 B1
(45) Date of Patent: Apr. 17, 2001

(54) RING BINDER MECHANISM

(75) Inventor: Weng Io Ng, Hong Kong (HK)

(73) Assignee: World Wide Stationery Manufacturing Company Limited, Kwai Chung (HK)

( * ) Notice: Subject to any disclaimer, the term of this patent is extended or adjusted under 35 U.S.C. 154(b) by 0 days.

(21) Appl. No.: 09/472,157

(22) Filed: Dec. 27, 1999

(51) Int. Cl.[7] ..... B42F 13/00; B42F 3/04; B42F 13/20

(52) U.S. Cl. ..... 402/36; 402/26; 402/37; 402/38; 402/39; 402/40; 402/41; 402/42

(58) Field of Search ..... 402/38, 26, 36–42; 24/703.5

(56) References Cited

U.S. PATENT DOCUMENTS 5,842,807 * 12/1998 To et al. ..... 402/26
5,879,097 * 3/1999 Cheng ..... 402/26
5,903,958 * 5/1999 Whaley ..... 24/703.5
5,924,811 * 7/1999 To et al. ..... 402/26
6,007,266 * 12/1999 Cheng et al. ..... 402/36

* cited by examiner

*Primary Examiner*—A. L. Wellington
*Assistant Examiner*—Mark T. Henderson
(74) *Attorney, Agent, or Firm*—Hall, Priddy, Myers & Vande Sande

(57) ABSTRACT

There is disclosed a ring binder mechanism (10) including an upper structure (12) supporting two pivotable plates (14) to which three pairs of half-ring members (16) are mounted, in which the plates (14) are pivotable between a first configuration in which the three pairs of half-ring members (16) are closed, and a second configuration in which the three pairs of half-ring members (16) are open, in which the ring binder mechanism (10) may be secured to a cardboard cover (60) via two rivets (20), in which each rivet (20) includes an anchor plate (40) from an upper major surface of which a post member (38) extends, in which the post member (38) includes an open end deformed to engage with the upper casing (12) via a bushing (22), and in which a sleeve (24) is positioned between the upper casing (12) and the anchor plate (40) of the rivet (20).

15 Claims, 6 Drawing Sheets

RING BINDER MECHANISM

This invention relates to a ring binder mechanism and, in particular, such a mechanism which may be secured to a base member, e.g. a cardboard cover, to form a ring binder for retaining loose-leaf paper.

BACKGROUND OF THE INVENTION

In conventional ring binders, the ring binder mechanism, i.e. the loose-leaf retaining device, is secured to a base member. The ring binder mechanism includes an elongate body portion comprising a curved upper casing supporting a pair of plates, and two rivets engaged with the upper casing, so as to prevent relative movement between the rivets and the upper casing. In particular, the rivet includes a post whose free end is deformable to engage with the upper casing. The plates are pivotable to selectively open or close several pairs of half-rings. The rivets may also be secured to the base member. The ring binder mechanism may thus be secured to the base member via the rivets, whereby relative movement between the ring binder mechanism and the base member is prevented.

Various ways have been proposed to enhance the engagement between the rivets and the upper casing, and thus the body portion, of the ring binder mechanism, so as to enhance the durability of the ring binder. It has, for example, been proposed to deform the free end of the post of the rivet such that it engages with both the upper surface and the lower surface of the upper casing. However, the force for effecting such an engagement between the post of the rivet and the upper casing will be relatively large, and may cause undesirable deformations at certain other locations of the rivet, e.g. the post.

It is thus an object of the present invention to provide a ring binder mechanism, and a ring binder, in which the above shortcoming is mitigated, or at least to provide a useful alternative to the public.

SUMMARY OF THE INVENTION

According to a first aspect of the present invention, there is provided a ring binder mechanism including an upper structure supporting a pivotable lower structure to which at least one pair of half-ring members are mounted, wherein the lower structure is pivotable between a first configuration in which the pair(s) of half-ring members are closed, and a second configuration in which the pair(s) of half-ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein said intermediate member includes a first end which abuts said first major surface of said plate member and wherein at least one support member is positioned between said upper structure and said first major surface of said plate member.

According to a second aspect of the present invention, there is provided a ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein said intermediate member includes a second end which engages with said upper structure, and wherein at least one support member is positioned between said upper structure and said plate member.

According to a third aspect of the invention there is provided a ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein at least part of said intermediate member is received through an aperture of said upper structure, and wherein at least one support member is positioned between said upper structure and said plate member.

According to a fourth aspect of the present invention there is provided a ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, and wherein at least one support member is positioned between said upper structure and said plate member, wherein said support member is engaged with said securing member via said intermediate member.

According to a fifth aspect of the invention there is provided a ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein at least one support member is positioned between said upper structure and said plate member, and wherein said support member includes a first end which abuts said upper structure.

According to a sixth aspect of this invention there is provided a ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein at least one support member is positioned between said upper structure and said plate member, and wherein said support member includes an internal surface at least part of which surrounds at least part of an outer surface of said intermediate member.

According to further aspects of the invention there are provided ring binders including ring binder mechanisms of any of the six aspects of the invention listed above secured to a base member.

BRIEF DESCRIPTION OF THE DRAWINGS

A preferred embodiment of the present invention will now be described, by way of an example only, wherein.

DETAILED DESCRIPTION OF THE PREFERRED EMBODIMENT

Figures 1, 2:
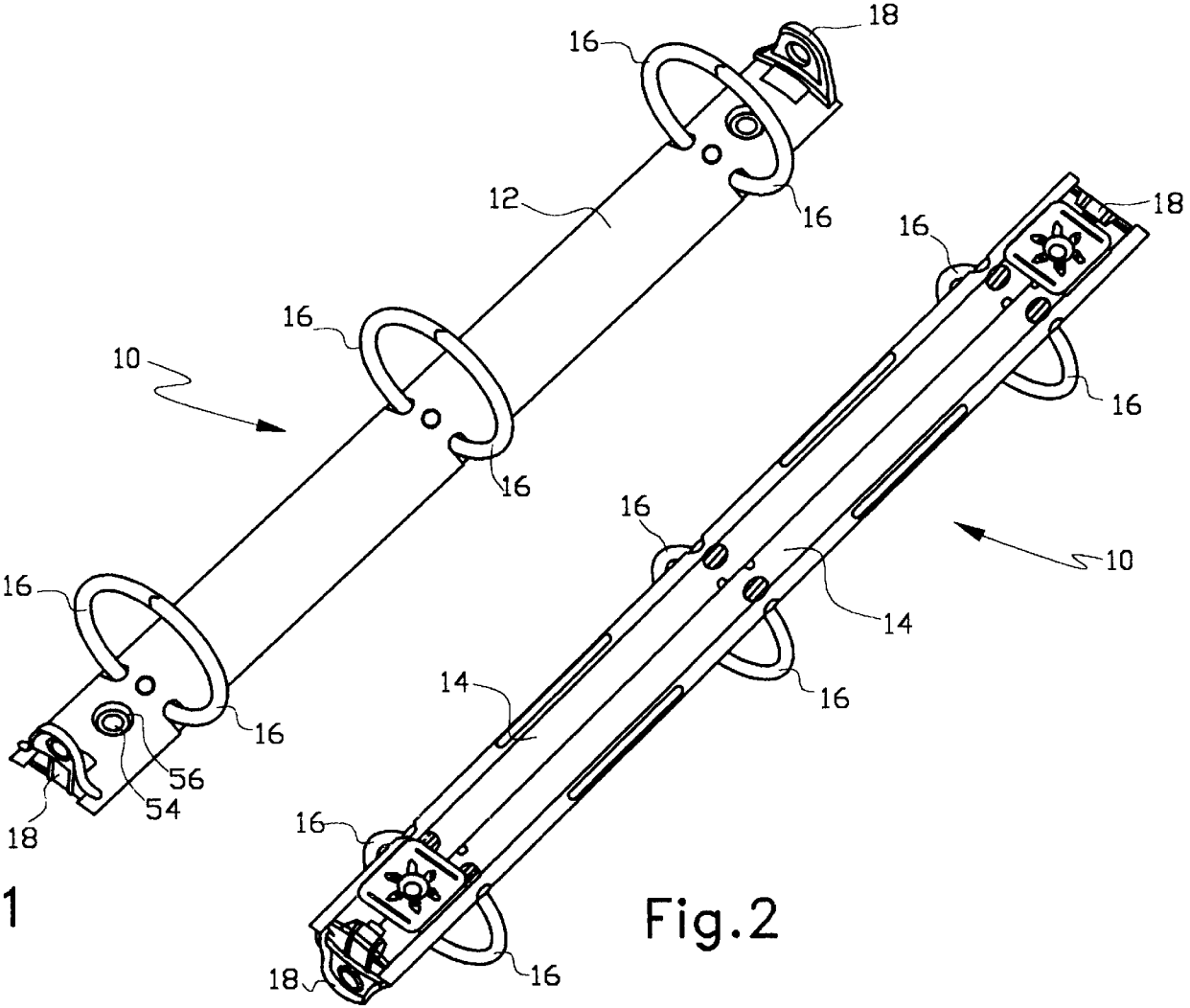
FIG. 1 is a top perspective view of a ring binder mechanism according to the present invention.
FIG. 2 is a bottom perspective view of the ring binder mechanism shown in FIG. 1.
Figure 3:
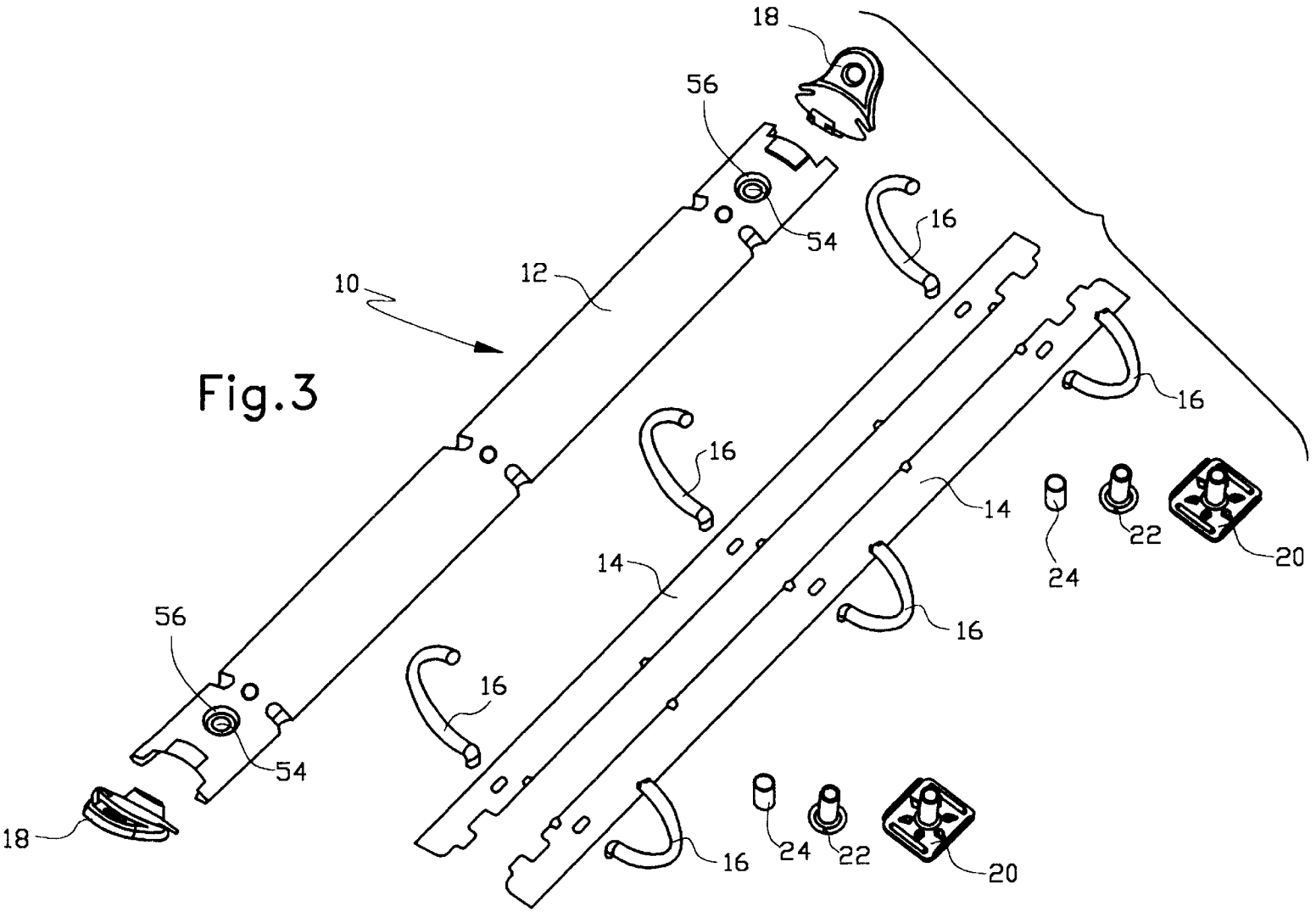
FIG. 3 is an exploded perspective view of the ring binder mechanism shown in FIG. 1.

A ring binder mechanism according to the present invention is shown in FIGS. 1 to 3, and generally designated as 10. The ring binder mechanism 10 includes a curved upper casing 12 supporting a pair of plates 14, to which three pairs of half-rings 16 are mounted. At each longitudinal end of the ring binder mechanism 10 is a lever 18 which may be manually operated to selectively pivot the plates 14, and thereby to selectively open or close the half-rings 16. The ring binder mechanism 10 also includes two rivets 20, two bushings 22 and two sleeves 24, the function and structure of which will be discussed below.

Figure 4A:
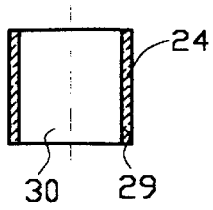
FIG. 4A is a longitudinal sectional view of the sleeve shown in FIG. 3.
Figure 5A:
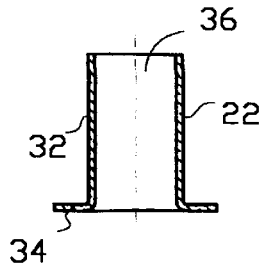
FIG. 5A is a longitudinal sectional view of the bushing shown in FIG. 3.
Figure 4B:
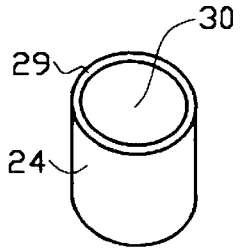
FIG. 4B is a top perspective view of the sleeve shown in FIG. 4A.
Figure 5B:
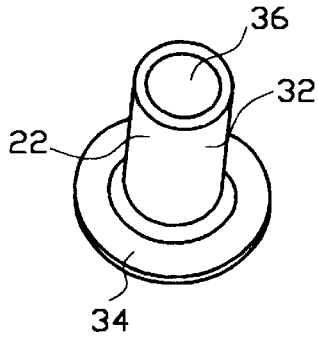
FIG. 5B is a top perspective view of the bushing shown in FIG. 5A.

Turning to FIGS. 4A and 4B, such show respectively a longitudinal sectional view and a top perspective view of the sleeves 24 shown in FIG. 3. The sleeve 24 is in the shape of a small tube with a circular wall 29 defining a central channel 30. As to FIGS. 5A and 5B, such show respectively a longitudinal sectional view and a top perspective view of the bushing 22 shown in FIG. 3. The bushing 22 includes a body portion 32 and a base portion 34. The body portion 32 is in the form of a post with a central through-hole 36. As to the base portion 34, such is formed in one piece with the body portion 32. It can be clearly seen that the diameter of the base portion 34 is wider than the diameter of the post 32, so that the bushing 22 can stand stably on the base portion 34.

Figure 6A:
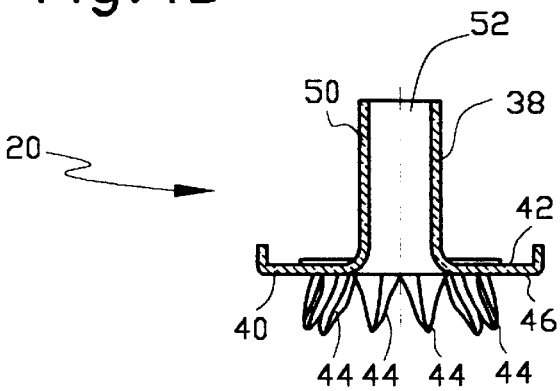
FIG. 6A is a longitudinal sectional view of the rivet shown in FIG. 3.
Figure 6B:
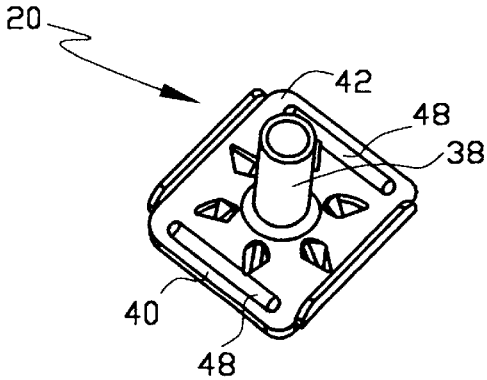
FIG. 6B is a top perspective view of the rivet shown in FIG. 6A.
Figure 6C:
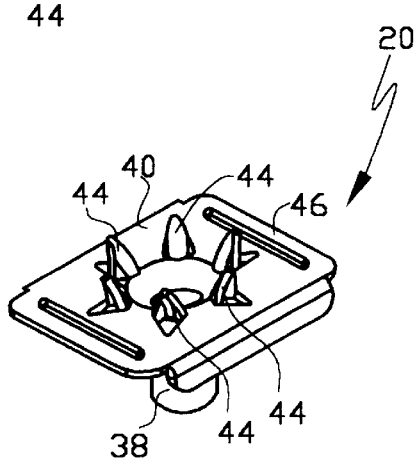
FIG. 6C is a bottom perspective view of the rivet shown in FIG. 6A.

Turning to FIGS. 6A to 6C, such show respectively a longitudinal sectional view, a top perspective view and a bottom perspective view of the rivet 20 shown in FIG. 3. The rivet 20 includes a post member 38 integrally formed with an anchor plate 40. The post member 38 extends from an upper surface 42 of the rivet 20, while six prongs 44 extend from a lower surface 46 of the rivet 20. For the purpose of enhancing the strength of the anchor plate 40, two parallel ridges 48 are provided on the upper surface 42 of the rivet anchor plate 40 of the rivet 20. Turning to the post member 38, it can be seen that such includes a circular wall 50 defining a central through-hole 52.

Figure 7C:
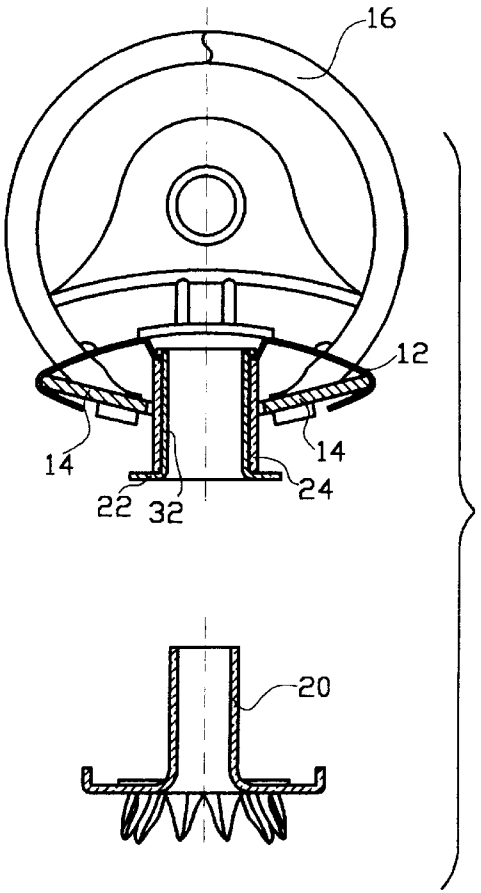
FIG. 7C is an exploded transverse sectional view of the ring binder mechanism shown in FIG. 1 in which the sleeve and the bushing are secured to the upper casing.
Figure 7B:
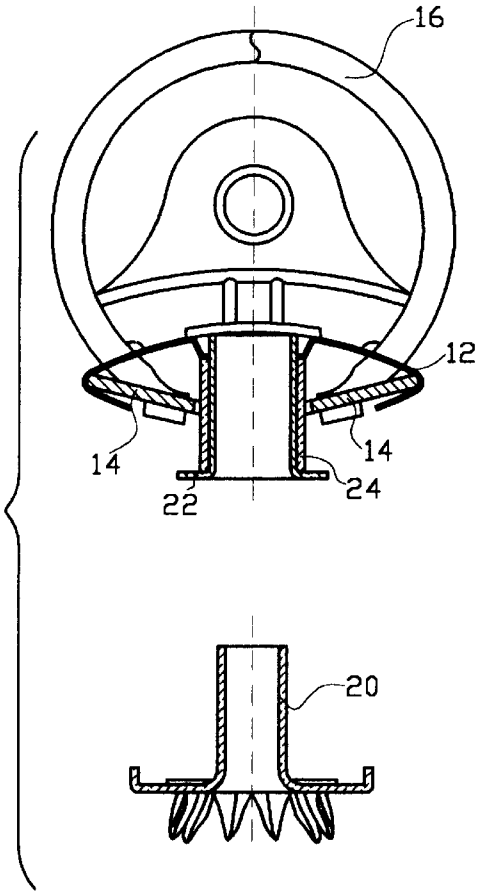
FIG. 7B is an exploded transverse sectional view of the ring binder mechanism shown in FIG. 1 in which the sleeve and the bushing are assembled with, but not secured to, the upper casing.
Figure 7A:
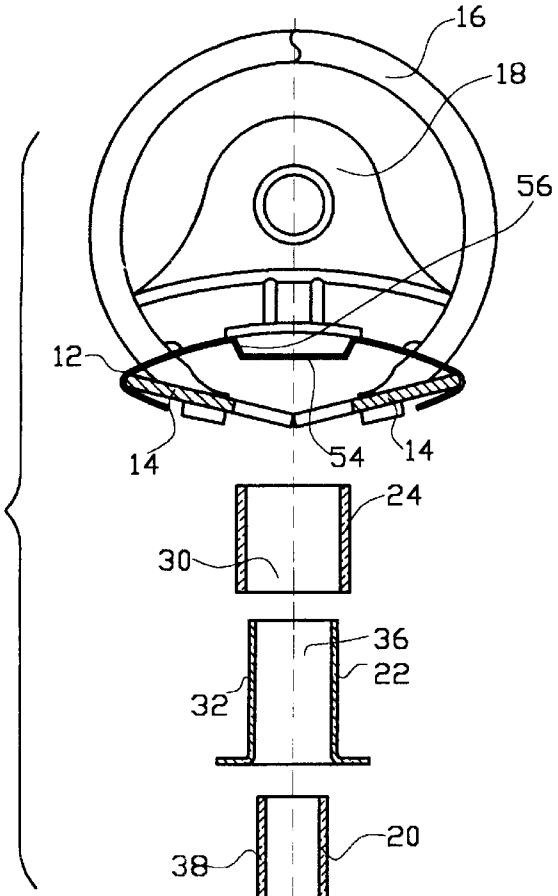
FIG. 7A is an exploded transverse sectional view of the ring binder mechanism shown in FIG. 1 in which the sleeve, the bushing and the rivet are not assembled with the upper casing.
Figure 7E:
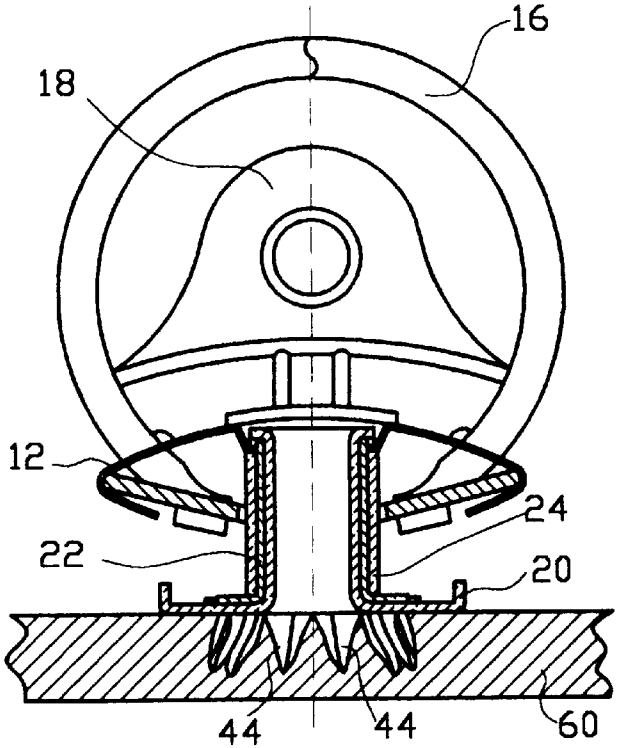
FIG. 7E is a transverse sectional view of the ring binder mechanism shown in FIG. 1 in which the sleeve, the bushing and the rivet are secured to the upper casing, and the ring binder mechanism is shown as secured to a base member.
Figure 7D:
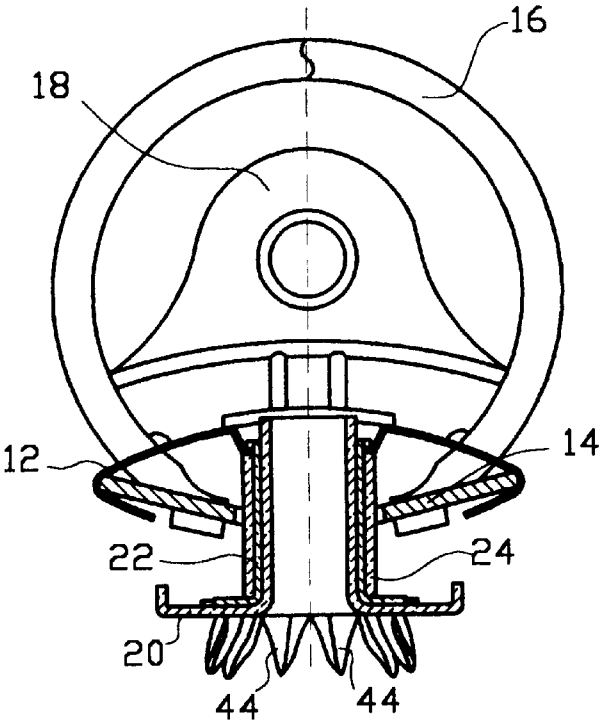
FIG. 7D is a transverse sectional view of the ring binder mechanism shown in FIG. 1 in which the rivet is assembled with, but not secured to the upper casing.
Figure 8B:
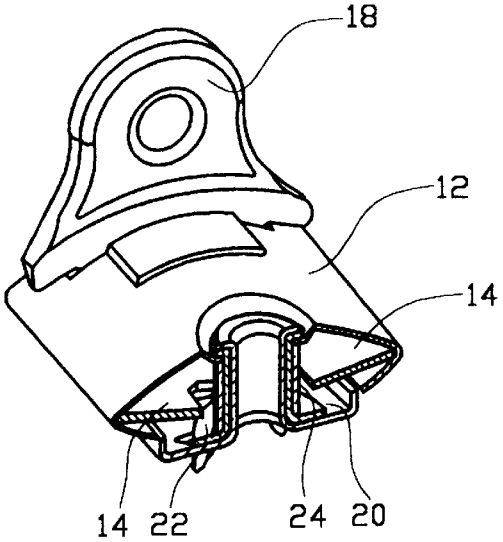
FIG. 8B is a sectional top perspective view of the ring binder mechanism shown in FIG. 1 in which the sleeve, the bushing and the rivet are secured to the upper casing.
Figure 8A:
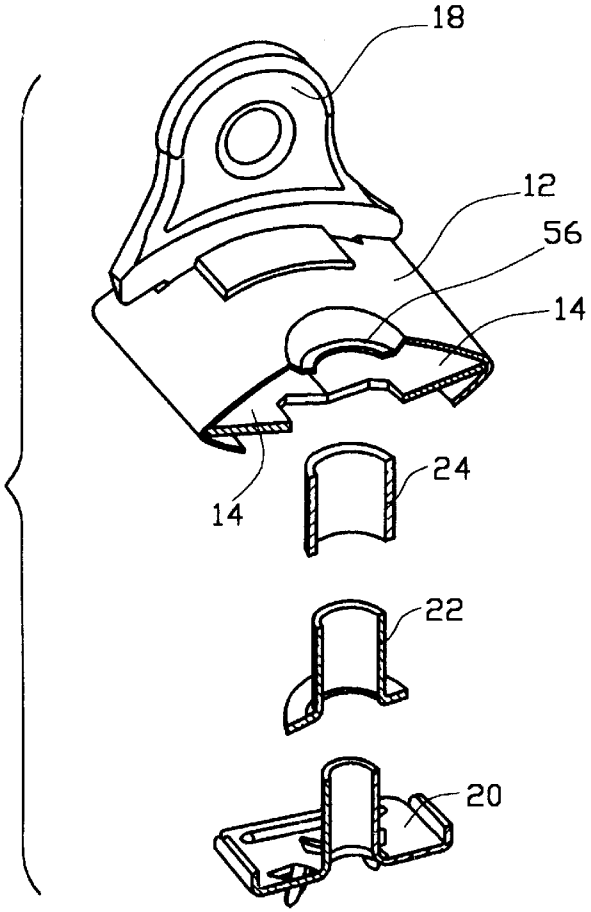
FIG. 8A is a sectional exploded top perspective view of the ring binder mechanism shown in FIG. 1 in which the sleeve, the bushing and the rivet are not assembled with the upper casing.

FIGS. 7A to 7E, 8A and 8B show the manner in which a ring binder according to the present invention is constructed. As can be seen in FIGS. 7A and 8A, the external diameter of the post 32 of the bushing 22 is the same as or slightly smaller than the internal diameter of the channel 30 of the sleeve 24. Similarly, the external diameter of the post member 38 of the rivet 20 is the same as or slightly smaller than the internal diameter of the central through-hole 36 of the bushing 22. By way of such an arrangement, the post 32 of the bushing 22 can be received within the channel 30 of the sleeve 24 (as shown in FIG. 7B), and the post member 38 of the rivet 20 can be received within the central through-hole 36 of the bushing 22.

Turning to FIG. 7B, such shows the post 32 of the bushing 22 as being received through an aperture 54 on a recessed portion 56 on the upper casing 12, shown more clearly in FIGS. 1, 3, 7A and 8A. The sleeve 24 is positioned between and abuts the lower surface of the recessed portion 56 and the base portion 34 of the bushing 22. The upper open end of the post 32 of the bushing 22 is then deformed, e.g. by punching, so as to engage with the upper surface of the recessed portion 56 on the upper casing 12. During the punching action, the sleeve 24 acts as a support to enhance better and proper deformation of the upper open end of the post 32 of the bushing 22. The bushing 22 and the sleeve 24 are thus secured to the upper casing 12, as shown in FIG. 7C.

Turning now to FIG. 7D, the post member 38 of the rivet 20 is shown as being received within the central through-hole 36 of the bushing 22. In particular, the post member 38 of the rivet 20 also extends through the aperture 54 of the recessed portion 56 of the upper casing 12. The upper open end of the post member 38 of the rivet 20 is then deformed, e.g. by punching, so as to engage indirectly with the upper surface of the recessed portion 56 of the upper casing 12 and via the deformed upper end of the bushing 22. During the punching action, the sleeve 24 acts as a support to enhance better and proper deformation of the upper open end of the post member 38 of the rivet 20. The rivet 20, the bushing 22 and the sleeve 24 are thus secured to the upper casing 12, as shown in FIGS. 7E and 8B.

As shown in FIG. 7E, the prongs 44 of the rivet 20 are driven into a base, e.g. a cardboard cover 60, so as to secure the rivet 20, and thus the ring binder mechanism 10, against any movement relative to the cover 60. A ring binder according to the present invention is thus constructed.

While a preferred embodiment of a ring binder mechanism according to the present invention is discussed above, it should of course be understood that various modifications and alterations may be made to this example without departing from the spirit of the present invention.

What is claimed is:

1. A ring binder mechanism including an upper structure supporting a pivotable lower structure to which at least one pair of half ring members are mounted, wherein the lower structure is pivotable between a first configuration in which said at least one pair of half rinq members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein said intermediate member includes a first end which abuts said first major surface of said plate member, and wherein at least one support member is positioned between said upper structure and said plate member.

2. A ring binder including a ring binder mechanism according to claim 2 secured to a base member.

3. A ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein said intermediate member includes a second end which engages with said upper structure, and wherein at least one support member is positioned between said upper structure and said plate member.

4. A ring binder mechanism according to claim 3 wherein said second end of said intermediate member engages with at least an upper surface of said upper structure.

5. A ring binder including a ring binder mechanism according to claim 3 secured to a base member.

6. A ring binder mechanism according to claim 4 wherein said second end of said intermediate member engages with at least an upper surface of a recessed area of said upper structure.

7. A ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein at least part of said intermediate member is received through an aperture of said upper structure, and wherein at least one support member is positioned between said upper structure and said plate member.

8. A ring binder including a ring binder mechanism according to claim 6 secured to a base member.

9. A ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein at least one support member is positioned between said upper structure and said plate member, and wherein said support member is engaged with said securing member via said intermediate member.

10. A ring binder including a ring binder mechanism according to claim 7 secured to a base member.

11. A ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said ring binder mechanism is adapted to be secured to a base member via at least one securing member, wherein said securing member includes a plate member with a first major surface from which at least a post member extends, wherein said post member includes an end deformed to engage with said upper structure via an intermediate member, wherein at least one support member is positioned between said upper structure and said plate member, and wherein said support member includes a first end which abuts said upper structure.

12. A ring binder mechanism according to claim 11 wherein said first end of said support member abuts a lower surface of said upper structure.

13. A ring binder including a ring binder mechanism according to claim 8 secured to a base member.

14. A ring binder mechanism including an upper structure supporting a pivotable lower structure to which at least one pair of half ring members are mounted, wherein the lower structure is pivotable between a first configuration in which said at least one pair of half ring members are closed, and a second configuration in which said at least one pair of half ring members are open, wherein said rinq binder mechanism is adapted to be secured to a base member via at least one securing member, wherein said securing member includes a plate member with a first major surface from which at least a post member extends, wherein said post member includes an end deformed to engage with said upper structure via an intermediate member, wherein at least one support member is positioned between said upper structure and said plate member, and wherein said support member includes an internal surface at least part of which surrounds at least part of an outer surface of said intermediate member.

15. A ring binder including a ring binder mechanism according to claim 10 secured to a base member.

* * * * *